US007505706B2

(12) United States Patent
Yoshida et al.

(10) Patent No.: US 7,505,706 B2
(45) Date of Patent: Mar. 17, 2009

(54) IMAGE FORMING APPARATUS

(75) Inventors: Kenzo Yoshida, Ikoma (JP); Yukio Kanaoka, Nara (JP); Takahiro Fukunaga, Sakurai (JP); Jinichi Nagata, Osaka (JP); Hideo Yoshikawa, Yamatokoriyama (JP); Takashi Matsuda, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/302,050

(22) Filed: Dec. 13, 2005

(65) Prior Publication Data

US 2006/0133849 A1 Jun. 22, 2006

(30) Foreign Application Priority Data

Dec. 20, 2004 (JP) ..... 2004-368428

(51) Int. Cl.
*G03G 15/00* (2006.01)

(52) U.S. Cl. ..... 399/107; 399/405; 399/407

(58) Field of Classification Search ..... 399/107, 399/407, 405

See application file for complete search history.

(56) References Cited

U.S. PATENT DOCUMENTS

2002/0081134 A1* 6/2002 Miyamoto et al. ..... 399/405
2004/0114958 A1* 6/2004 Katsuyama et al. ..... 399/107
2005/0232672 A1* 10/2005 Nakamura et al. ..... 399/405

FOREIGN PATENT DOCUMENTS

| | | |
|---|---|---|
| JP | 2002-046922 | 2/2002 |
| JP | 2002-171372 | 6/2002 |
| JP | 2002-173262 | 6/2002 |
| JP | 2002-308520 | 10/2002 |
| JP | 2004-035132 | 2/2004 |
| JP | 2004-286880 | 10/2004 |

* cited by examiner

*Primary Examiner*—David M Gray
*Assistant Examiner*—Joseph S. Wong
(74) *Attorney, Agent, or Firm*—Renner, Otto, Boisselle & Sklar, LLP

(57) ABSTRACT

An image forming apparatus includes a scanner section, an image forming section, and a functional unit. The scanner section is configured to read image information by scanning an image bearing side of a document sheet. The image forming section is located above or below the scanner section with a space section provided therebetween and is configured to perform image formation processing on a recording medium based on the image information read. The space section has at least one open vertical side. The functional unit is removably fitted into the space section through the open side.

6 Claims, 4 Drawing Sheets

IMAGE FORMING APPARATUS

CROSS REFERENCE

This Nonprovisional application claims priority under 35 U.S.C. § 119(a) on Patent Application No. 2004-368428 filed in Japan on Dec. 20, 2004, the entire contents of which are hereby incorporated by reference.

BACKGROUND OF THE INVENTION

The present invention relates to an image forming apparatus configured to perform image formation processing on a recording medium by an image forming section based on image information read from a document at a scanner section.

Among conventional image forming apparatus, such as copying machines and multifunctional digital processors, of the type having a scanner section for reading image information from an image bearing side of a document sheet and an image forming section for performing image formation processing based on such image information, there is one which is provided with a post-processing device for performing post-processing on a recording medium finished with image formation. Examples of such post-processing to be performed by the post-processing device include punching and stapling.

Further, such a conventional image forming apparatus is configured to deliver a recording medium finished image formation onto a delivered sheet tray fitted on a lateral side of the apparatus. For this reason, the post-processing device flanks the image forming apparatus to enlarge the footprint of the apparatus as a whole, with the result that the image forming apparatus requires an increased space for its installation.

In attempt to avoid such an inconvenience, one known apparatus includes vertically arranged scanner section and image forming section with an intervening space section therebetween, a sheet delivery section formed in the space section, and a post-processing device disposed in the sheet delivery section, as disclosed in Japanese Patent Laid-Open Publication No. 2002-308520. This arrangement makes it possible to accommodate the post-processing device within the image forming apparatus thereby to reduce the installation space-for the apparatus.

Because the conventional image forming apparatus, as a whole, has an integral configuration comprising the scanner section and the image forming section, the scanner section or the image forming section cannot individually be replaced with an alternative. For this reason, the conventional apparatus cannot flexibly accommodate changes in function such as processing speed changes or replacements required in the event of failure.

In attempt to avoid such an inconvenience, one known apparatus has scanner section, operating section and image forming section designed in respective modules which are electrically interconnected after their positioning and fixing to enable easy changes in function or easy replacements in the event of failure, as disclosed in Japanese Patent Laid-Open Publication No. 2002-171372.

Though the arrangement described in the former publication utilizes the space formed between the scanner section and the image forming section, the delivered sheet tray and the post-processing device are fixedly disposed in the space and, hence, the space cannot be utilized more effectively.

The arrangement described in the latter publication is characterized by comprising replaceable modules or units for replacement when necessary for improvement in the performance of the apparatus, but is not designed to utilize such a space effectively.

A feature of the present invention is to provide an image forming apparatus which is capable of easily and effectively utilizing its space section to meet a required function thereby facilitating changes in specifications about processing on recording mediums finished with image formation for improvement in versatility.

SUMMARY OF THE INVENTION

An image forming apparatus according to the present invention includes a scanner section, an image forming section, and a functional unit. The scanner section is configured to read image information by scanning an image bearing side of a document sheet. The image forming section is located above or below the scanner section with a space section provided therebetween and is configured to perform image formation processing on a recording medium based on the image information read. The space section has at least one open vertical side. The functional unit is removably fitted into the space section through the open side.

It is possible that: the image forming section of the image forming apparatus is provided with a delivery section; and the functional unit comprises a delivered sheet tray. The delivery section is configured to deliver a recording medium having undergone image formation processing to the space section. The delivered sheet tray is configured to receive the recording medium delivered from the delivery section.

It is possible that: the image forming apparatus according to the present invention further comprises a post-processing section; the image forming section is provided with a delivery section; and the functional unit comprises a transport path. The post-processing section is located on one lateral side of the space section and configured to perform post-processing on a recording medium having undergone image formation processing by the image forming section. The delivery section is configured to deliver the recording medium having undergone image formation processing to the space section. The transport path is configured to transport the recording medium delivered from the delivery section to the post-processing section.

The foregoing and other features and attendant advantages of the present invention will become more apparent from the reading of the following detailed description of the invention in conjunction with the accompanying drawings.

DETAILED DESCRIPTION OF THE PREFERRED EMBODIMENTS

Figure 1:
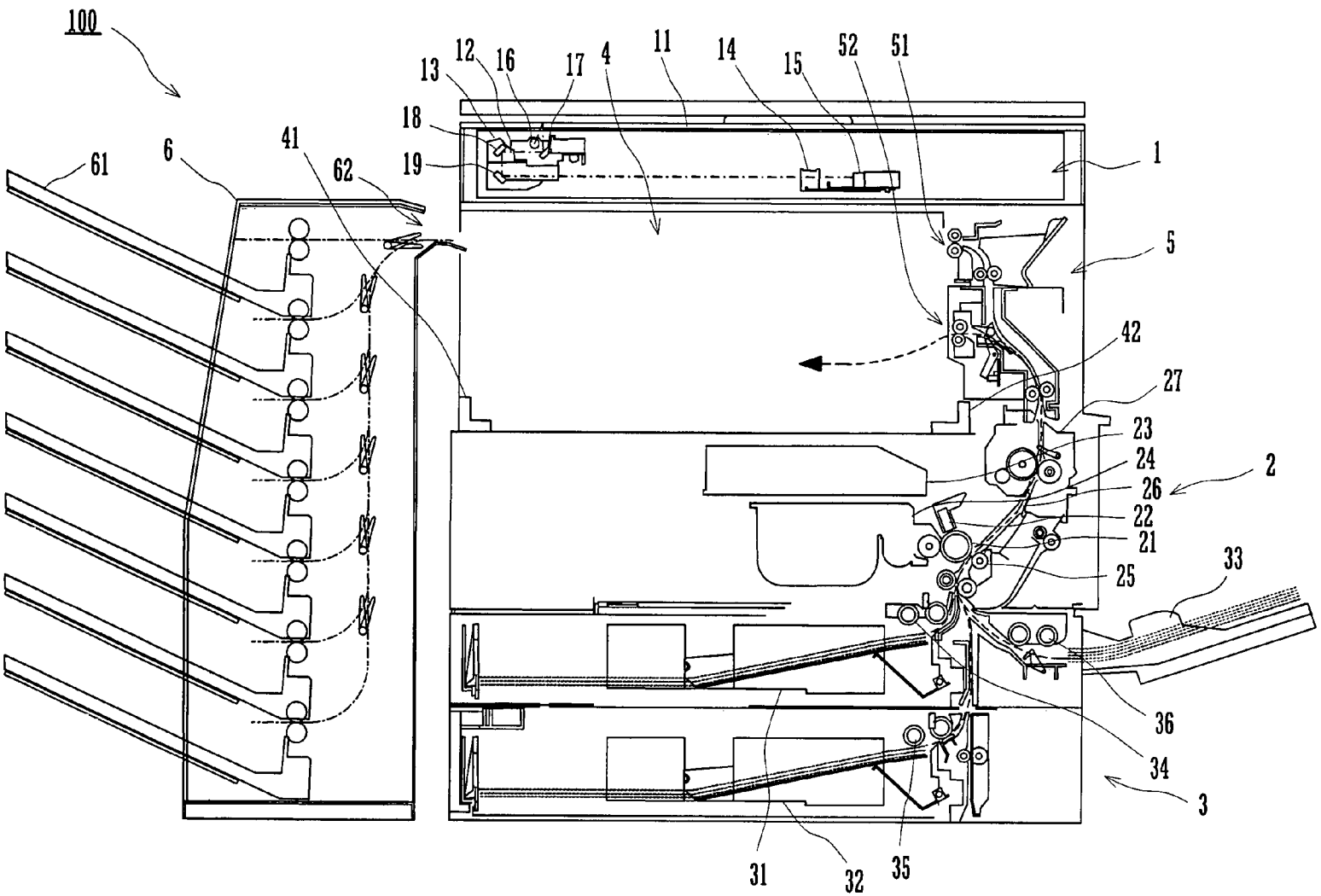
FIG. 1 is a schematic view showing the construction of an image forming apparatus according to an embodiment of the present invention.

Hereinafter, the construction of an image forming apparatus according to the present invention will be described in detail with reference to the accompanying drawings. FIG. 1 is a schematic view showing the construction of an image forming apparatus according to an embodiment of the present invention. The image forming apparatus 100 shown includes a scanner section 1, an image forming section 2, a sheet feed section 3, a space section 4, a delivery section 5, and a post-processing device 6.

The image forming section 2 is disposed below the scanner section 1, with the space section 4 and delivery section 5 intervening therebetween. The sheet feed section 3 is located below the image forming section 2. The post-processing device 6, which corresponds to the post-processing section defined by the present invention, is fitted on the left-hand side of the image forming apparatus 100.

The scanner section 1 includes a platen 11 on the upper side thereof, and, below the platen 11, first and second scan units 12 and 13, a lens 14, and a solid-state imaging device (CCD) 15. The first scan unit 12 carries a light source 16 and a mirror 17 thereon and is configured to move horizontally. The second scan unit 13 carries mirrors 18 and 19 thereon and is configured to move horizontally at a velocity ½ as high as the velocity of the first scan unit 12.

In the scanner unit 1, the light source 16 exposes the entire surface of a document sheet placed on the platen 11 to light as the first and second scan units 12 and 13 move horizontally away from their home positions. Light emitted from the light source 16 and then reflected by the document sheet is guided toward the lens 14 with its optical path length kept constant by the mirrors 17 to 19. The lens 14 focuses the reflected light on the light-receiving surface of the CCD 15. The CCD 15 outputs an electric signal corresponding to the quantity of light of the reflected light received at the light-receiving surface to the image forming section 2. The electric signal outputted from the scanner section 1 is converted to digital data, which in turn is subjected to predetermined image processing and then stored as image data in the image forming section 2.

A photosensitive drum 21 is rotatably supported in the image forming section 2. Around the photosensitive drum 21 there are disposed an electrostatic charger 22, an exposure unit 23, a development unit 24 and a transfer roller 25. The electrostatic charger 22 electrostatically charges the surface of the photosensitive drum 21 uniformly. The exposure unit 23 irradiates the surface of the photosensitive drum 21 with a light image modulated according to the image data to form an electrostatic latent image on the surface of the photosensitive drum 21. The development unit 24 feeds developer to the surface of the photosensitive drum 21 to develop the electrostatic latent image into a toner image. The transfer roller 25 is positioned opposite to the surface of the photosensitive drum 21 across a recording sheet fed from the sheet feed section 3 and produces a transfer electric field between the surface of the photosensitive drum 21 and the transfer roller 25 to transfer the toner image to the recording sheet.

Within the image forming apparatus 100 the image forming section 2 is continuous with the delivery section 5. The delivery section 5 is located on the right-hand side of the space section 4. The image forming section 2 defines a sheet feed path 26 having a lower end continuous with the sheet feed section 2 and an upper end reaching the delivery section 5. A fixing unit 27 is disposed on the sheet feed path 26. The fixing unit 27 heats and pressurizes the recording sheet bearing the toner image transferred thereto to fix the toner image to the surface of the recording sheet. The delivery section 5 has vertically arranged two delivery ports 51 and 52 in communication with the space section 4. The recording sheet having passed through the fixing unit 27 is delivered into the space section 4 by the delivery section 5.

The sheet feed section 3 includes sheet feed cassettes 31 and 32, each of which contains a predetermined number of recording sheets. A manual feed tray 33 is attached to the right-hand side of the sheet feed section 3. A predetermined number of recording sheets are placed on the manual feed tray 33. The sheet feed section 3 feeds recording sheets one by one into the sheet feed path 26 of the image forming section 2 by a sheet feed roller 34, 35 or 36 rotating.

The post-processing device 6 defines an inlet 62 in its upper portion on the right-hand side thereof and is fitted with plural trays arranged in tiers on the left-hand side thereof. The post-processing device 6 sorts or stacks plural recording sheets finished with image formation by means of the trays 61, the recording sheets having been transported into the device 6 through the inlet 62. The post-processing device 6 is optionally fitted to the image forming apparatus 100 as the need arises.

The space section 4 has a rectangular parallelepiped configuration with its front and left-hand sides open. Rails 41 and 42 are fixed on the right and left edges of the bottom of the space section 4. For example, the rail 41 has an L-shaped section that is invariant in the fore-and-aft direction and the rail 42 has an L-shaped section that is 90° rotated counterclockwise from the L-shape of the rail 41 and is invariant in the fore-and-aft direction. The rail 42 may be eliminated by the use of the left-hand sidewall of the delivery section 5 instead. A functional unit to be described later is removably fitted into the space section 4 from the front side.

Figure 2A:
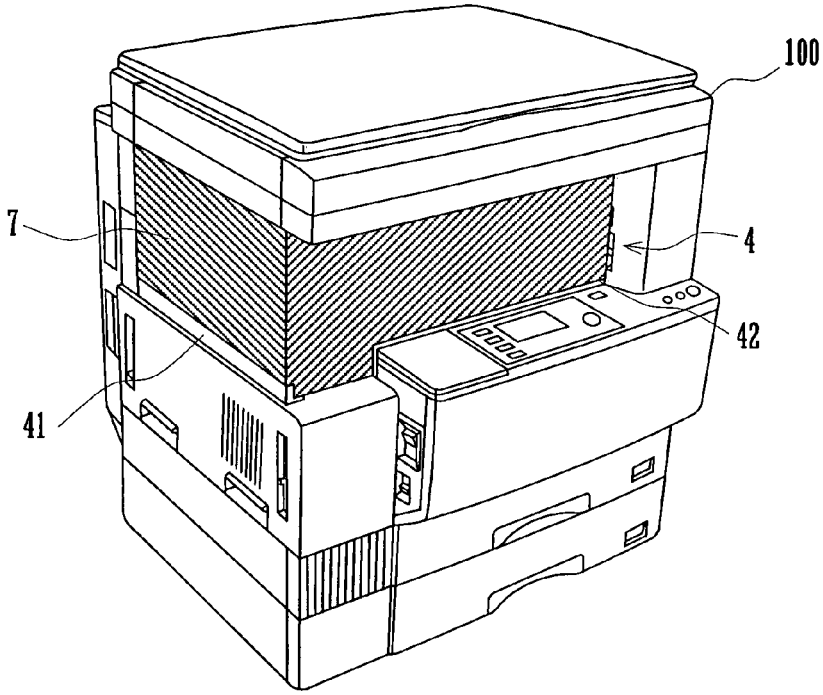
FIG. 2A is a perspective view showing the image forming apparatus in a state where a functional unit is fitted in a space section of the apparatus.
Figure 2B:
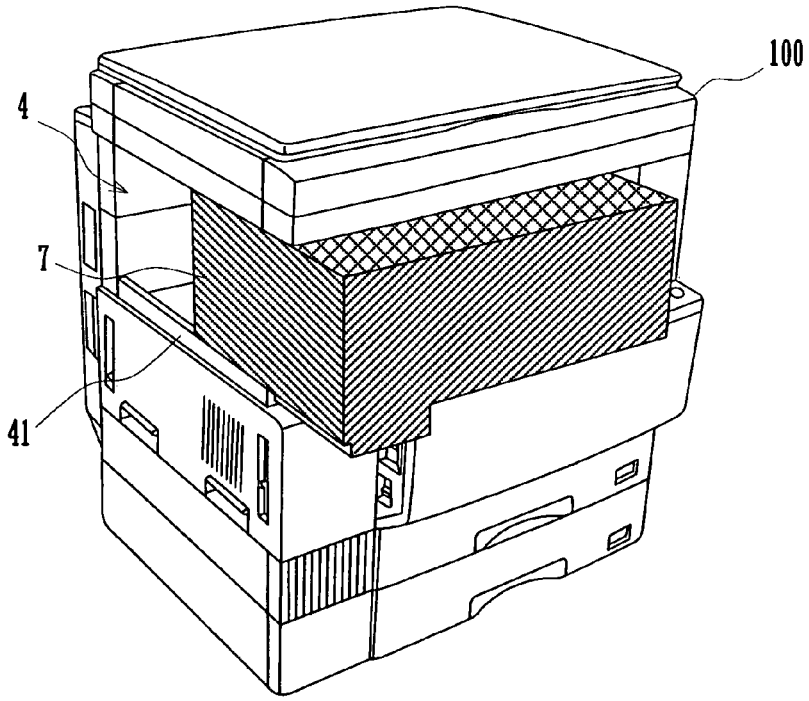
FIG. 2B is a perspective view showing the image forming apparatus in a state where the functional unit is half fitted into or removed from the space section of the apparatus.

FIG. 2A is a perspective view showing the image forming apparatus in a state where the functional unit is fitted in the space section of the apparatus and FIG. 2B is a perspective view showing the image forming apparatus in a state where the functional unit is half fitted into or removed from the space section of the apparatus. A projected figure of the functional unit 7 on the front side is the same as that of the space section 4 of the image forming apparatus 100 and is invariant in the fore-and-aft direction. Accordingly, the functional unit 7 can be fitted into the space section 4 from the front side of the space section 4 to assume the state shown in FIG. 2A via the state shown in FIG. 2B. Also, the functional unit 7 can be withdrawn to assume the state shown in FIG. 2B from the state shown in FIG. 2A. For fitting or removal of the functional unit 7 the rails 41 and 42 guide the functional unit 7 in the direction in which the functional unit 7 is required to move. Though not shown in FIGS. 2A and 2B, the functional unit 7 is open on its right- and left-hand sides and front side.

Figure 3A:
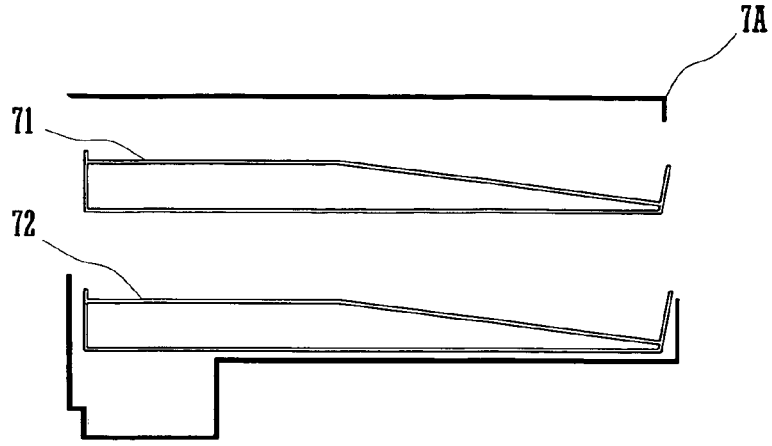
FIG. 3A is a schematic view showing the structure of a first functional unit for use in the image forming apparatus.
Figure 3B:
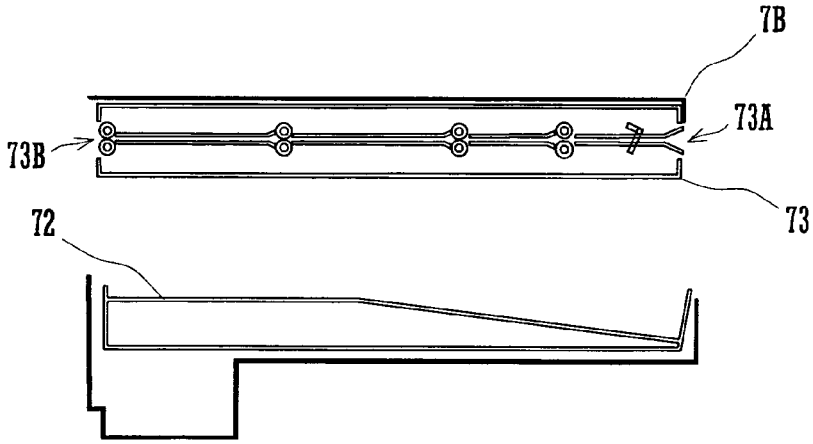
FIG. 3B is a schematic view showing the structure of a second functional unit for use in the image forming apparatus.
Figure 3C:
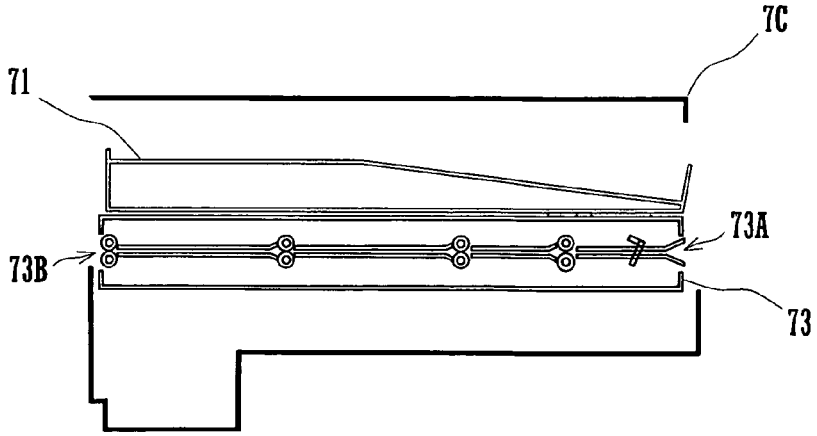
FIG. 3C is a schematic view showing the structure of a third functional unit for use in the image forming apparatus.

FIGS. 3A to 3C each schematically illustrates the structure of a functional unit for use in the aforementioned image forming apparatus. The first functional unit 7A shown in FIG. 3A includes two delivered sheet trays 71 and 72 arranged in tiers therein. The second functional unit 7B shown in FIG. 3B includes a transport path 73 in an upper portion within the unit 7B and a delivered sheet tray 72 in a lower portion within the unit 7B. The third functional unit 7C shown in FIG. 3C includes delivered sheet tray 71 in an upper portion within the unit 7C and transport path 73 in a lower portion within the unit 7C.

The delivered sheet trays 71 and 72 each receive and hold thereon recording sheets finished with image formation. Each of the delivered sheet trays 71 and 72 has an open upper side. The transport path 73 transports each recording sheet finished with image formation from the right-hand side to the post-processing device 6. The transport path 73 has an inlet 73A on the right-hand side and an outlet 73B on the left-hand side. The front side of the transport path 73 can be closed and opened by means of a cover member.

When the functional unit 7A is fitted into the space section 4 of the image forming apparatus 100, the two delivered sheet trays 71 and 72 are positioned in tiers in the space section 4. The functional unit 7A as fitted in the space section 4 has its right-hand side positioned close to the left-hand side of the delivery section 5. In this state, the delivery ports 51 and 52 of the delivery section 5 are located on the upper right side of the delivered sheet tray 71 and the upper right side of the delivered sheet tray 72, respectively. Since the right-hand side of the functional unit 7A is open, each recording sheet delivered from the delivery port 51 is received and held on the delivered sheet tray 71, while each recording sheet delivered from the delivery port 52 received and held on the delivered sheet tray 72.

The functional unit 7A and the space section 4 are open on their left-hand sides and on their front sides and the delivered sheet trays 71 and 72 are open on their upper sides. For this reason, recording sheets held on the delivered sheet tray 71 or 72 can be removed from the left-hand side or front side of the image forming apparatus 100.

Since the scanner section 1 is located above the delivered sheet trays 71 and 72, the image-bearing side of a recording sheet held on each of the delivered sheet trays 71 and 72 cannot easily be seen. Therefore, an outsider passing by the image forming apparatus 100 cannot easily see or read the details of the image formed on the recording sheet held on the delivered sheet tray 71 or 72 and, hence, the confidentiality of the image can be maintained.

When the functional unit 7B is fitted into the space section 4 of the image forming apparatus 100, the transport path 73 is positioned above the delivered sheet tray 72 in the space section 4. The functional unit 7B as fitted in the space section 4 has its right-hand side positioned close to the left-hand side of the delivery section 5. In this state, the delivery port 51 of the delivery section 5 faces the inlet 73A of the transport path 73 while the delivery port 52 of the delivery section 5 is located on the upper right side of the delivered sheet tray 72. Since the right-hand side of the functional unit 7B is open, each recording sheet finished with image formation and delivered from the delivery port 51 is introduced into the transport path 73 while each recording sheet finished with image formation and delivered from the delivery port 52 received and held on the delivered sheet tray 72.

In the case where the functional unit 7B is fitted in the space section 4, the post-processing device 6 is fitted on the left-hand side of the image forming apparatus 100. Therefore, the functional unit 7B as fitted in the space section 4 has its left-hand side positioned close to the right-hand side of the post-processing device 6. In this state, the outlet 73B of the transport path 73 faces the inlet 62 of the post-processing device 6. Since the left hand side of the functional unit 7B is open, each recording sheet finished with image formation and delivered from the outlet 73B is introduced into the post-processing device 6 through the inlet 62.

When the functional unit 7C is fitted into the space section 4 of the image forming apparatus 100, the delivered sheet tray 71 is positioned above the transport path 73 in the space section 4. The functional unit 7C as fitted in the space section 4 has its right-hand side positioned close to the left-hand side of the delivery section 5. In this state, the delivery port 51 of the delivery section 5 is located on the upper right side of the delivered sheet tray 71 while the delivery port 52 of the delivery section 5 faces the inlet 73A of the transport path 73. Since the right-hand side of the functional unit 7C is open, each recording sheet finished with image formation and delivered from the delivery port 51 is received and held on the delivered sheet tray 71 while each recording sheet finished with image formation and delivered from the delivery port 52 introduced into the transport path 73.

In the case where the functional unit 7C is fitted in the space section 4, another post-processing device not shown is fitted on the left-hand side of the image forming apparatus 100. This post-processing device has an inlet positioned to face the outlet 73B of the transport path 73 of the functional unit 7C. Since the left hand side of the functional unit 7C is open, each recording sheet finished with image formation and delivered from the outlet 73B is introduced into the post-processing device through the inlet.

Because the front side of the transport path 73 in the functional unit 7B or 7C can be closed and opened by means of the cover member, a recording sheet that remains within the transport path 73 when a paper jam occurs can be removed by opening the front side of the transport path 73.

As described above, the image forming apparatus 100 is configured to allow the functional unit 7 to be removably fitted into the space section 4 from the front side of the space section 4. For this reason, even after installation of the image forming apparatus 100, the delivery ports 51 and 52 of the delivery section 5 can be exposed by withdrawal of the functional unit 7 from the space section 4. Thus, it is possible to facilitate maintenance operations including parts replacement operations in the vicinity of the delivery ports 51 and 52 of the delivery section 5 and jam eliminating operations.

Figure 4A:
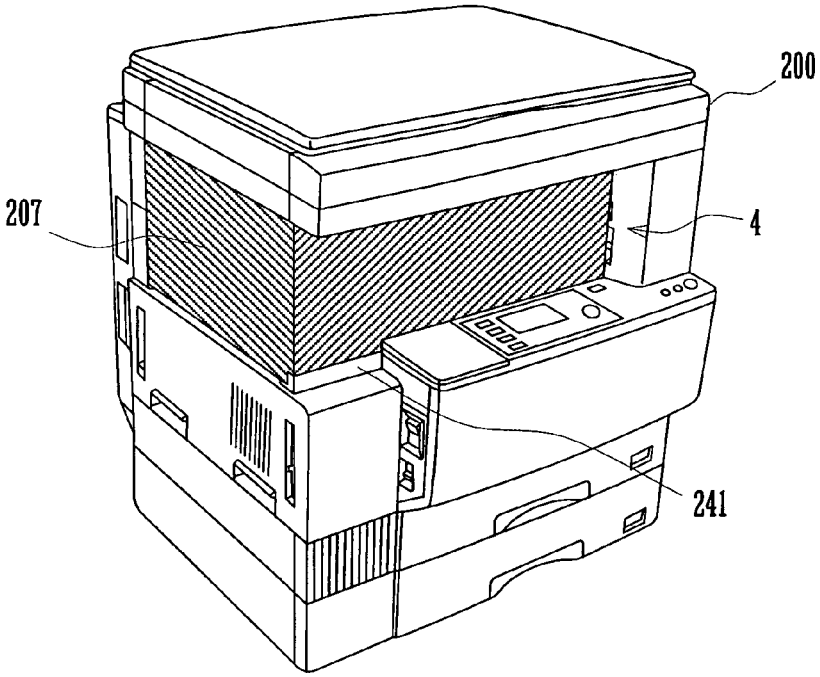
FIG. 4A is a perspective view showing an image forming apparatus according to another embodiment of the present invention in a state where a functional unit is fitted in a space section of the apparatus.
Figure 4B:
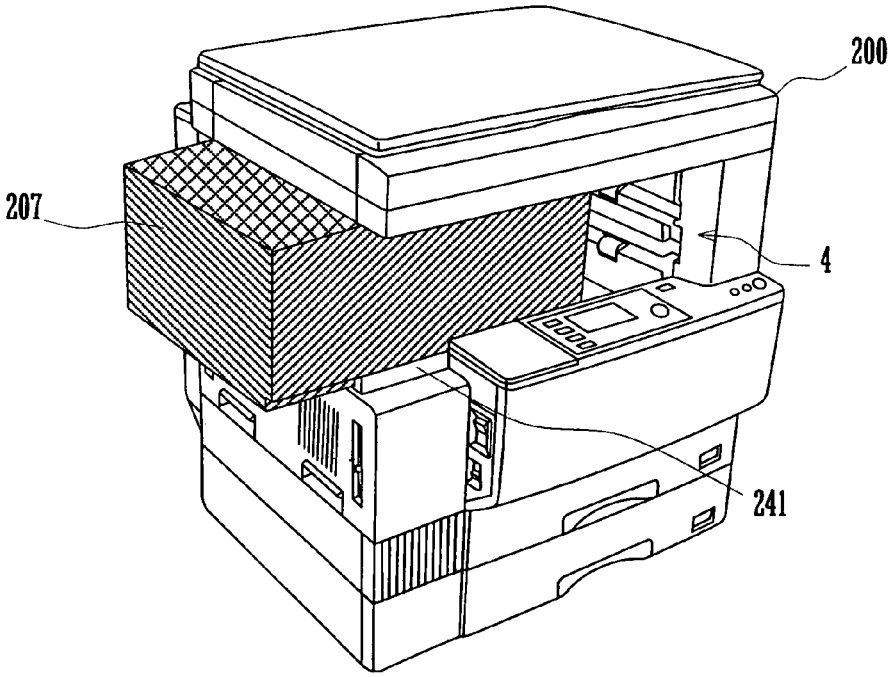
FIG. 4B is a perspective view showing the image forming apparatus according to the second embodiment in a state where the functional unit is half fitted into or removed from the space section of the apparatus.

FIG. 4A is a perspective view showing an image forming apparatus according to another embodiment of the present invention in a state where a functional unit is fitted in a space section of the apparatus; and FIG. 4B is a perspective view showing the image forming apparatus according to this embodiment in a state where the functional unit is half fitted into or removed from the space section of the apparatus. In the image forming apparatus 200 shown, a rail 241 is fixed on the front edge of the bottom of the space section 4. For example, the rail 41 has an L-shaped section that is invariant in the transverse direction. The image forming apparatus 200 is similar in other features to the image forming apparatus 100.

A projected figure of the functional unit 207 on the lateral side is the same as that of the space section 4 of the image forming apparatus 200 and is invariant in the transverse direction. Accordingly, the functional unit 207 can be fitted into the space section 4 from the left-hand side of the space section 4 to assume the state shown in FIG. 4A via the state shown in FIG. 4B. Also, the functional unit 207 can be withdrawn to assume the state shown in FIG. 4B from the state shown in FIG. 4A. For fitting or removal of the functional unit 7 the rear wall of the space section 4 and the rail 241 guide the functional unit-207 in the direction in which the functional unit 207 is required to move.

Though not shown in FIGS. 4A and 4B, the functional unit 207 is open on its right- and left-hand sides and front side.

Further, the functional unit 207 has an inside structure as same as any one of the structures shown in FIGS. 3A to 3C, like the functional unit 7.

As described above, the image forming apparatus 200 is configured to allow the functional unit 207 to be removably fitted into the space section 4 from the left-hand side of the space section 4. For this reason, even after installation of the image forming apparatus 200, the delivery ports 51 and 52 of the delivery section 5 can be exposed by withdrawing the functional unit 207 toward the left-hand side of the image forming apparatus 200 to a certain extent without the need to completely removing the functional unit 207 from the space section 4. Thus, it is possible to facilitate maintenance operations including parts replacement operations in the vicinity of the delivery ports 51 and 52 of the delivery section 5 and jam eliminating operations.

The foregoing embodiments are illustrative in all points and should not be construed to limit the present invention. The scope of the present invention is defined not by the foregoing embodiment but by the following claims. Further, the scope of the present invention is intended to include all modifications within the meanings and scopes of claims and equivalents.

What is claimed is:

1. An image forming apparatus comprising:

a scanner section configured to read image information by scanning an image bearing side of a document sheet;

an image forming section configured to perform image formation processing on a recording medium based on the image information read, the image forming section located above or below the scanner section with a space section provided therebetween, the space section having at least one open vertical side; and a plurality of functional units, each of which having a different function, and each of which enclosed inside a respective casing having the same shape and size as the whole of the space section and adapted to interchangeably fit inside the space section substantially without a gap through the open side, wherein:

the image forming section is provided with a delivery section configured to deliver a recording medium having undergone image formation processing to the space section; and each of the functional units comprises a delivered sheet tray configured to receive the recording medium delivered from the delivery section.

2. An image forming apparatus comprising:

a scanner section configured to read image information by scanning an image bearing side of a document sheet;

an image forming section configured to perform image formation processing on a recording medium based on the image information read, the image forming section located above or below the scanner section with a space section provided therebetween, the space section having at least one open vertical side; and a plurality of functional units, each of which having a different function, and each of which enclosed inside a respective casing having the same shape and size as the whole of the space section and adapted to interchangeably fit inside the space section substantially without a gap through the open side, further comprising a post-processing section located on one lateral side of the space section and configured to perform post-processing on a recording medium having undergone image formation processing by the image forming section, wherein:

the image forming section is provided with a delivery section configured to deliver the recording medium having undergone image formation processing to the space section; and at least one of the functional units comprises a transport path configured to transport the recording medium delivered from the delivery section to the post-processing section.

3. An image forming apparatus comprising:

a scanner section configured to read image information by scanning an image bearing side of a document sheet;

an image forming section configured to perform image formation processing on a recording medium based on the image information read, the image forming section located above or below the scanner section with a space section provided therebetween, the space section having at least one open vertical side; and a plurality of functional units, each of which having a different function, and each of which enclosed inside a respective casing having the same shape and size as the whole of the space section and adapted to interchangeably fit inside the space section substantially without a gap through the open side, further comprising a post-processing section located on one lateral side of the space section and configured to perform post-processing on a recording medium having undergone image formation processing by the image forming section, wherein:

the image forming section is provided with a delivery section configured to deliver the recording medium having undergone image formation processing to the space section; and at least one of the functional units comprises a delivered sheet tray configured to receive the recording medium delivered from the delivery section, and a transport path configured to transport the recording medium delivered from the delivery section to the post-processing section.

4. The image forming apparatus according to claim 1, wherein the open side of the space section is open to a front side or one lateral side of the apparatus.

5. The image forming apparatus according to claim 2, wherein the open side of the space section is open to a front side or one lateral side of the apparatus.

6. The image forming apparatus according to claim 3, wherein the open side of the space section is open to a front side or one lateral side of the apparatus.

* * * * *